US008272974B2

(12) United States Patent
Mickelson et al.

(10) Patent No.: US 8,272,974 B2
(45) Date of Patent: Sep. 25, 2012

(54) HYBRID GOLF CLUB HEAD

(75) Inventors: Philip A. Mickelson, Rancho Santa Fe, CA (US); Daniel M. Stevens, Cardiff, CA (US); William C. Watson, Temecula, CA (US); Alan Hocknell, Carlsbad, CA (US); Luke R. Williams, Carlsbad, CA (US); Roger Cleveland, Los Angeles, CA (US)

(73) Assignee: Callaway Golf Company, Carlsbad, CA (US)

( * ) Notice: Subject to any disclaimer, the term of this patent is extended or adjusted under 35 U.S.C. 154(b) by 320 days.

(21) Appl. No.: 12/814,744

(22) Filed: Jun. 14, 2010

(65) Prior Publication Data

US 2010/0323811 A1 Dec. 23, 2010

Related U.S. Application Data

(60) Provisional application No. 61/218,167, filed on Jun. 18, 2009.

(51) Int. Cl.
*A63B 53/04* (2006.01)

(52) U.S. Cl. ..... 473/314; 473/328; 473/345; 473/349

(58) Field of Classification Search ..... 473/314, 473/328, 345, 349
See application file for complete search history.

(56) References Cited

U.S. PATENT DOCUMENTS 4,214,754 A 7/1980 Zebelean
4,465,221 A 8/1984 Schmidt
5,447,309 A 9/1995 Vincent
D372,063 S * 7/1996 Hueber ..... D21/752
5,582,553 A 12/1996 Ashcraft et al.
5,665,014 A 9/1997 Sanford et al.
5,785,605 A 7/1998 Helmstetter
5,911,102 A 6/1999 Takahashi et al.
5,985,208 A 11/1999 Zedalis et al.
5,989,493 A 11/1999 LaSalle et al.
6,027,686 A 2/2000 Takahashi et al.
6,074,310 A 6/2000 Ota
6,244,976 B1 6/2001 Murphy et al.
6,322,746 B1 11/2001 LaSalle et al.
6,334,817 B1 1/2002 Ezawa et al.
6,350,407 B1 2/2002 Sakata et al.
6,364,788 B1 4/2002 Helmstetter et al.
6,409,612 B1 6/2002 Evans et al.
6,478,842 B1 11/2002 Gressel et al.
6,602,147 B2 * 8/2003 Shiraishi ..... 473/291
6,605,006 B2 * 8/2003 Mason ..... 473/252
6,623,375 B2 * 9/2003 Davies ..... 473/314
6,669,898 B2 12/2003 Gressel et al.
6,739,983 B2 5/2004 Helmstetter et al.
6,767,418 B1 7/2004 Zhang et al.
D532,469 S 11/2006 Oldknow
7,396,296 B2 7/2008 Evans
D578,588 S * 10/2008 Oldknow et al. ..... D21/752
7,494,424 B2 * 2/2009 Williams et al. ..... 473/329
D592,260 S 5/2009 Green et al.
D592,261 S 5/2009 Green et al.
(Continued)

*Primary Examiner* — Stephen L. Blau
(74) *Attorney, Agent, or Firm* — Michael A. Catania; Rebecca Hanovice; Sonia Lari

(57) ABSTRACT

A hybrid type golf club head is disclosed herein. The hybrid golf club head preferably has an increased heel/toe camber to minimize drag through rough when a golfer swings the hybrid golf club. A sole of the hybrid golf club head is relieved to allow for the face angle to open without the leading edge lifting too high.

2 Claims, 5 Drawing Sheets

U.S. PATENT DOCUMENTS

| | | | | |
|---|---|---|---|---|
| D594,918 | S | 6/2009 | Prichard et al. | |
| 7,905,797 | B2 * | 3/2011 | Gilbert et al. | 473/287 |
| 2004/0055696 | A1 * | 3/2004 | Reyes et al. | 156/242 |
| 2007/0149309 | A1 * | 6/2007 | Ford | 473/328 |
| 2008/0070718 | A1 * | 3/2008 | Sanchez | 473/328 |
| 2008/0119303 | A1 * | 5/2008 | Bennett et al. | 473/338 |
| 2009/0181789 | A1 * | 7/2009 | Reed et al. | 473/290 |
| 2010/0248860 | A1 * | 9/2010 | Guerrette et al. | 473/345 |
| 2011/0177880 | A1 * | 7/2011 | Schweigert | 473/345 |

* cited by examiner

HYBRID GOLF CLUB HEAD

CROSS REFERENCES TO RELATED APPLICATIONS

The present application claims priority to U.S. Provisional Patent Application No. 61/218,167, filed on Jun. 17, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a hybrid golf club head.

2. Description of the Related Art

The prior art discloses many hybrid golf club heads.

The inventors wanted a hybrid that could play like an iron in the fairway and perform better from the rough. The inventors didn't like how the current hybrids would tend to hit "fliers" from the rough and lose backspin.

The inventors also wanted the golf club to slide easily through the grass and play from a variety of lies and face angles.

These features were not available in current hybrid golf clubs.

BRIEF SUMMARY OF THE INVENTION

In order to provide a hybrid with the desired qualities, the inventors moved the center of gravity forward and higher to give a trajectory more like an iron. The inventors also added iron grooves to help with grass & debris removal.

The inventors also designed the sole such that the leading edge wouldn't lift up when the face angle was very open.

One aspect of the present invention is a hybrid golf club head. The hybrid golf club head includes a body comprising a crown section, a sole section and a face section. The sole section is relieved to allow for a face angle to open without a leading edge lifting too high.

Another aspect of the present invention is a hybrid golf club head comprising a body comprising a crown section, a sole section and a face section with at least one of a plurality of scorelines placed high on the face section.

Yet another aspect of the present invention is a hybrid golf club head comprising a body comprising a crown section, a sole section and a face section with the body having an increased heel/toe camber to minimize drag through rough during a golf swing.

Yet another aspect of the present invention is a hybrid golf club head comprising a body comprising a crown section, a sole section and a face section with the body having a forward center of gravity.

Yet another aspect of the present invention is a hybrid golf club head comprising a body comprising a crown section, a sole section and a face section with a mass placed rearward on an interior of the sole section to increase the moment of inertia of the body.

The body is preferably composed of a stainless steel material. The body is alternatively composed of a titanium alloy material.

The hybrid golf club head preferably has a loft angle ranging from 18 degrees to 28 degrees. The hybrid golf club head preferably has a volume less than 200 cubic centimeters.

The hybrid golf club head preferably has a volume ranging from 50 to 150 cubic centimeters. The hybrid golf club head more preferably has a volume ranging from 60 to 100 cubic centimeters. The hybrid golf club head most preferably has a volume ranging from 70 to 90 cubic centimeters.

The hybrid golf club head preferably has a mass ranging from 210 grams to 240 grams.

The hybrid golf club head preferably has a moment of inertia Izz about a center of gravity ranging from 2000 to 3000 grams-centimeters squared. The hybrid golf club head more preferably has a moment of inertia Izz about a center of gravity ranging from 2300 to 2700 grams-centimeters squared.

The hybrid golf club head preferably has a moment of inertia Ixx about a center of gravity ranging from 1900 to 2500 grams-centimeters squared. The hybrid golf club head more preferably has a moment of inertia Ixx about a center of gravity ranging from 2100 to 2300 grams-centimeters squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
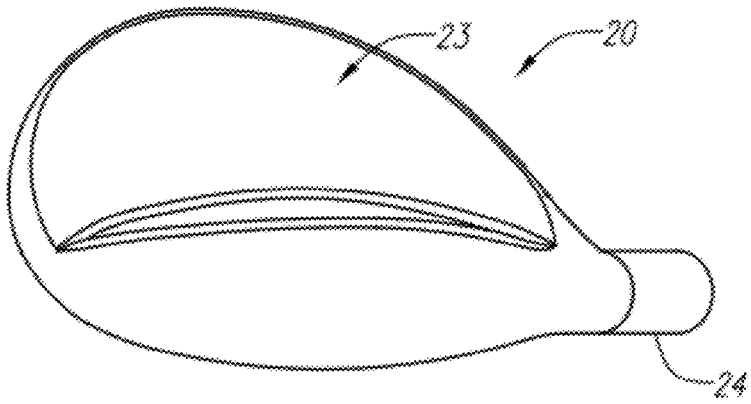
FIG. 1 is a bottom plan view of a hybrid golf club head.
Figure 2:
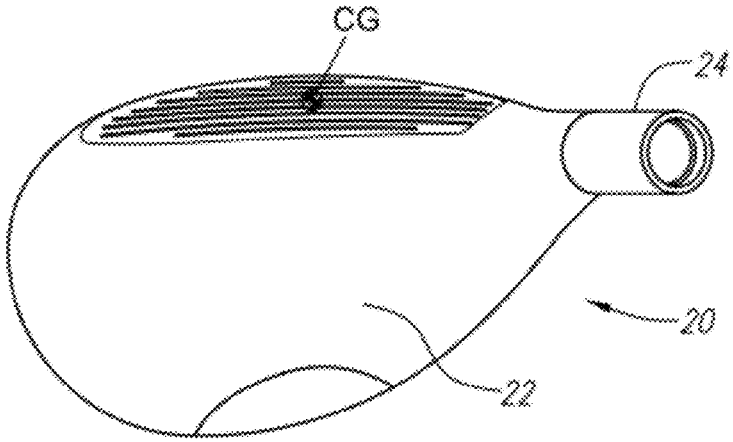
FIG. 2 is a top plan view of the hybrid golf club head of FIG. 1.
Figure 3:
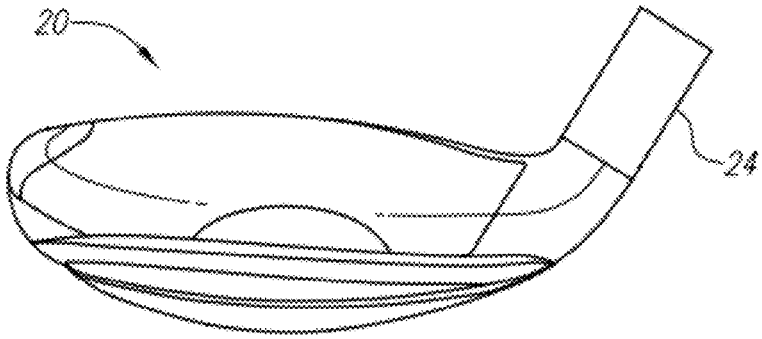
FIG. 3 is a rear elevational view of the hybrid golf club head of FIG. 1.

As shown in FIGS. 1-12, the hybrid golf club head 20 has a body 21, a crown section 22, a sole section 23, a hosel 24 and a face 25. A heel end 26 of the hybrid golf club head 20 is located on the side with the hosel 24 and a toe end 27 of the hybrid golf club head 20 opposes the heel end 26.

The body 21 is preferably composed of a stainless steel material. Alternatively, the body 21 is composed of another iron alloy material, a titanium alloy, an aluminum alloy material or the like.

Figure 12:
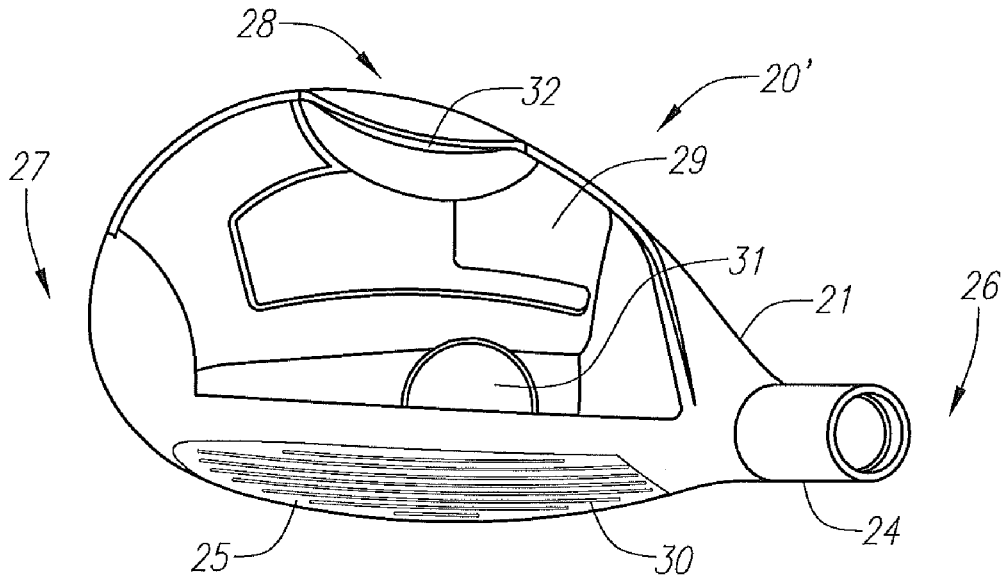
FIG. 12 is a top plan view of a hybrid golf club head with a crown section removed to illustrate a hollow interior of the hybrid golf club head.

The hybrid golf club head 20 preferably has a hollow interior 29 as shown in FIG. 12. A first mass 31 is placed forward near the face 25 to position the CG forward. A second mass 32 is placed on a rear end 28 of the interior of the sole section 23 to increase the moment of inertia.

The hybrid golf club head 20 has scorelines 30 placed high on the face to help with debris removal. The hybrid golf club head 20 also preferably has an iron scoreline profile, which is most preferably machined V grooves.

Figure 13:
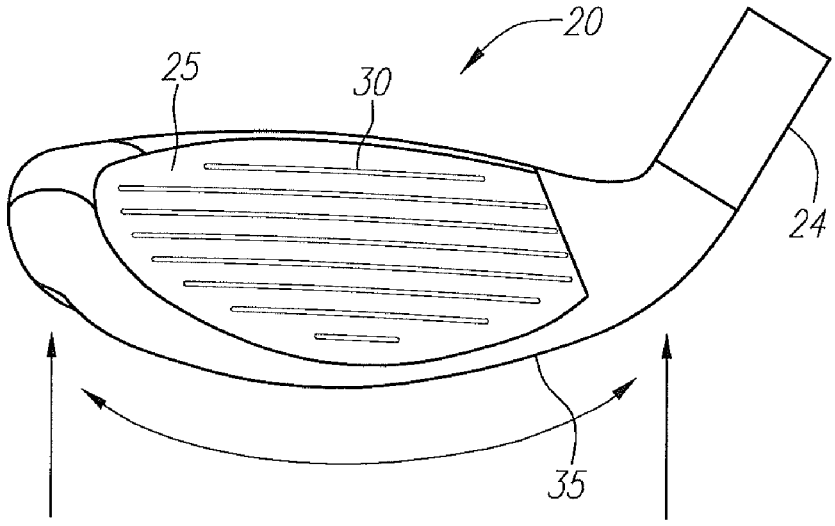
FIG. 13 is a front plan view of the hybrid golf club head of FIG. 7.

As shown in FIG. 13, the hybrid golf club head 20 preferably has an increased heel/toe camber 35 to minimize drag through rough when a golfer swings the hybrid golf club.

The shape of sole section 23 has C-grind for relief in the heel and toe. This provides a narrower sole in the fairway so the club takes divots more like an iron. The C-grind also allows for more versatility with a wide range of face angles.

Figure 8:
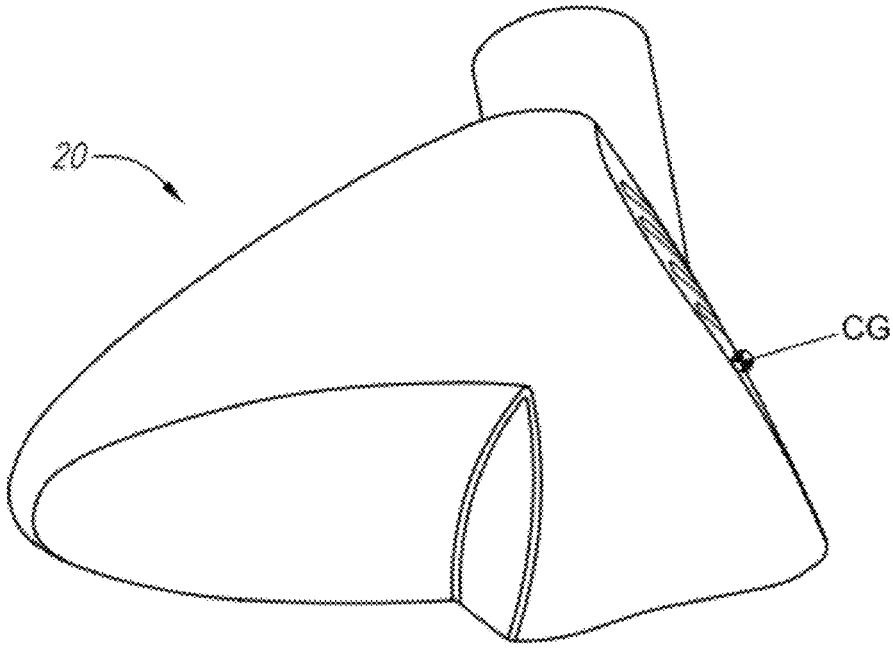
FIG. 8 is a side perspective view of the hybrid golf club head of FIG. 7.
Figure 9:
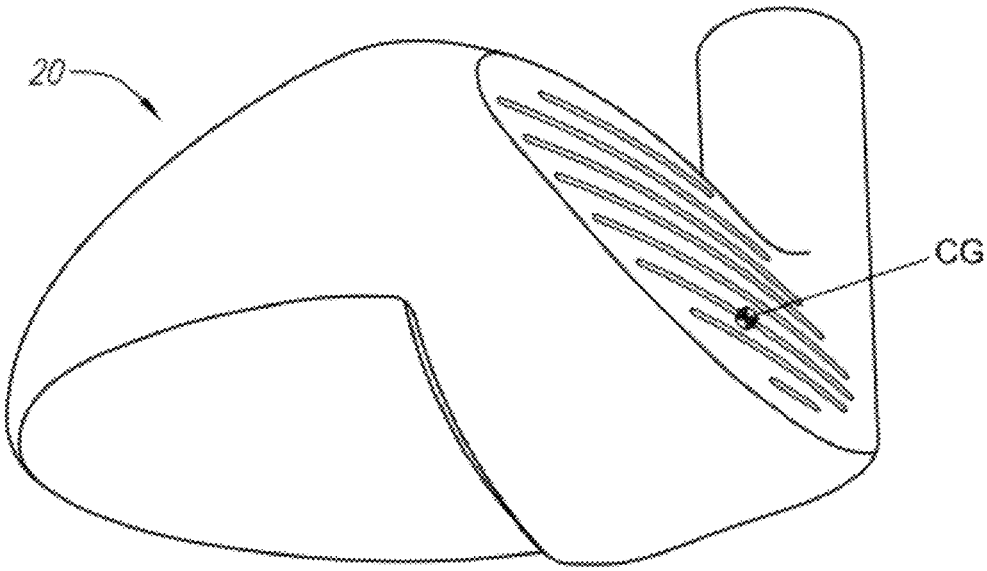
FIG. 9 is a side perspective view of the hybrid golf club head of FIG. 7.
Figure 10:
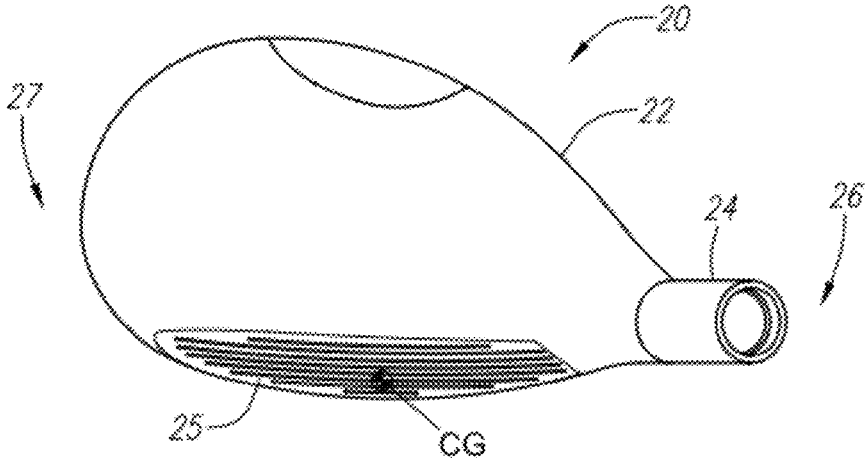
FIG. 10 is a top plan view of the hybrid golf club head of FIG. 7.
Figure 11:
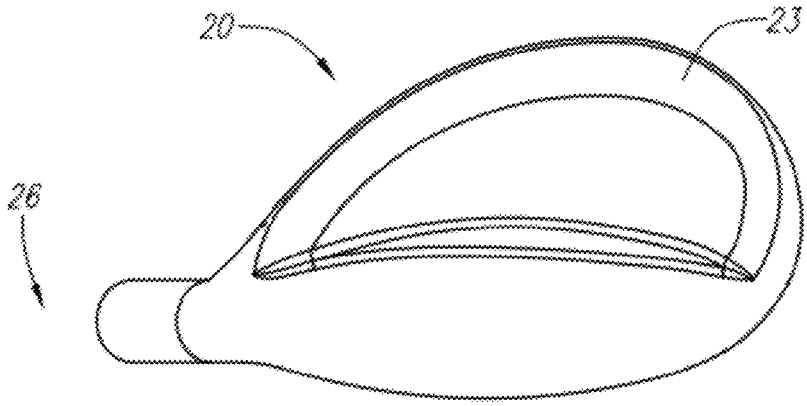
FIG. 11 is a bottom plan view of the hybrid golf club head of FIG. 7.

As shown in FIGS. 8 and 9, the sole section 23 was relieved to allow for the face angle to open without the leading edge lifting too high. In prior art hybrid golf club heads, the back end would normally hit and quickly lift the leading edge as a golfer tried to open the face. The hybrid golf club head 20 overcomes this problem by providing a relieved sole section 23. The dimension from a face 25 to a rear end 29 of the hybrid golf club head 20 was reduced to also allow for the face angle to open without the leading edge lifting too high.

TABLE ONE

| Property | Value |
|---|---|
| Loft | 18 degrees |
| Lie | 58.8 degrees |
| Bulge | 12.5 |
| Roll | 12.0 |
| Mass | 228 grams |
| CG location X | 0.386 inch |
| CG location Y | 1.084 inches |
| CG location Z | 0.723 inch |
| Moment of inertia about CG, Ixx | 2255 g-cm2 |
| Moment of inertia about CG, Izz | 2490 |
| Moment of inertia about CG, Iyy | 639 |

Figure 4:
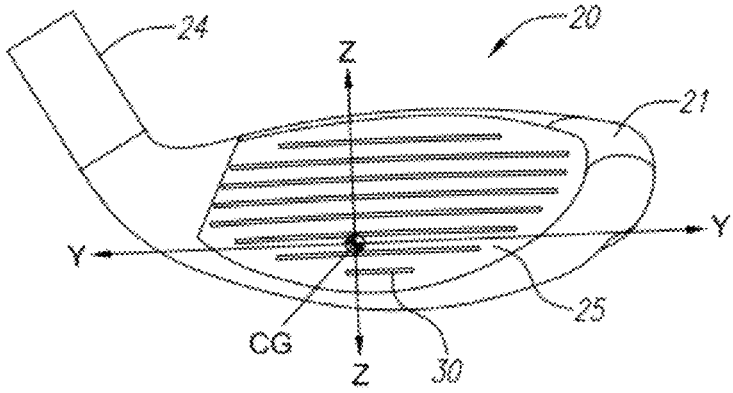
FIG. 4 is a front elevational view of the hybrid golf club head of FIG. 1.
Figure 5:
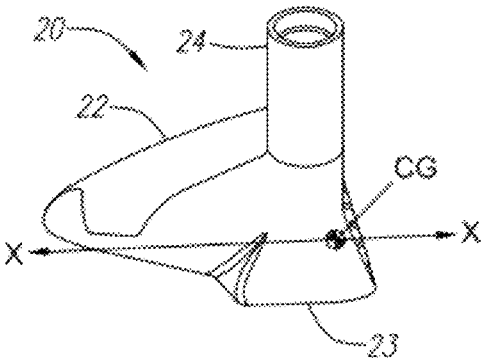
FIG. 5 is a heel side view of the hybrid golf club head of FIG. 1.
Figure 6:
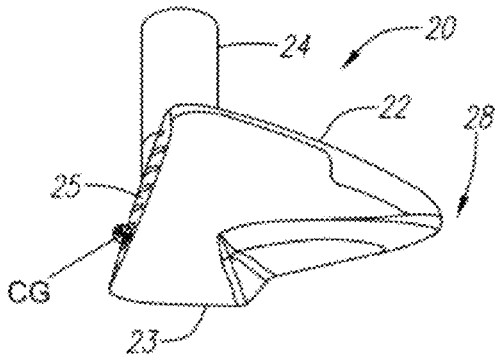
FIG. 6 is toe side view of the hybrid golf club head of FIG. 1.
Figure 7:
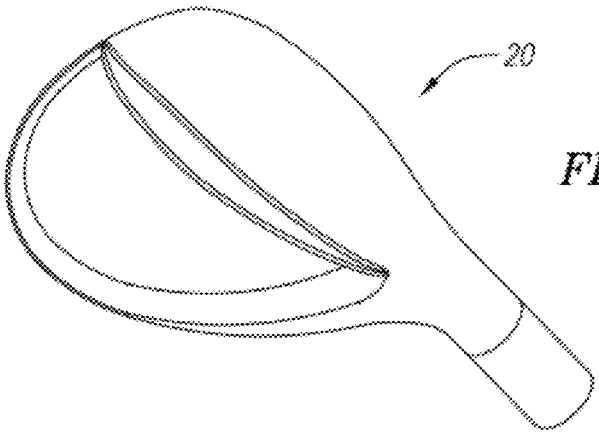
FIG. 7 is a bottom perspective view of a hybrid golf club head.

Table One illustrates mass properties for a preferred embodiment of the hybrid golf club 20. A more thorough explanation of the moment of inertia measurements is explained in Murphy et al., U.S. Pat. No. 7,387,577, which is hereby incorporated by reference in its entirety. As shown in FIGS. 4 and 5, the Z axis lies in a crown section 22 to a sole section 23 direction, the X axis lies in a front to rear direction, and the Y axis lies in a heel to tow direction.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A hybrid golf club head comprising:

a body comprising a hosel, a crown section, a sole section and a face section, the body composed of a stainless steel material;

wherein the hybrid golf club head has a volume ranging from 70 to 90 cubic centimeters;

wherein the hybrid golf club head has a mass ranging from 210 grams to 240 grams;

wherein the hybrid golf club head has a loft angle ranging from 18 degrees to 28 degrees;

wherein the hybrid golf club head has a moment of inertia Izz about a center of gravity ranging from 2300 to 2700 grams-centimeters squared and a moment of inertia Ixx about a center of gravity ranging from 1900 to 2500 grams-centimeters squared;

wherein a center of gravity of the hybrid golf club head is forward of the hosel of the hybrid golf club head.

2. The hybrid golf club head according to claim 1 wherein the face section comprises a plurality of scorelines having V-shaped grooves.

* * * * *